US011857091B2

(12) United States Patent
Spiro et al.

(10) Patent No.: US 11,857,091 B2
(45) Date of Patent: Jan. 2, 2024

(54) SNAP-FIT FRAMING SYSTEM

(71) Applicant: Tracer Imaging LLC, Ossining, NY (US)

(72) Inventors: Steven M. Spiro, Chappaqua, NY (US); Ryan Kelly, Scarsdale, NY (US)

(73) Assignee: Tracer Imaging LLC, Ossining, NY (US)

( * ) Notice: Subject to any disclaimer, the term of this patent is extended or adjusted under 35 U.S.C. 154(b) by 0 days.

(21) Appl. No.: 17/988,229

(22) Filed: Nov. 16, 2022

(65) Prior Publication Data

US 2023/0157464 A1 May 25, 2023

Related U.S. Application Data

(63) Continuation of application No. 17/388,762, filed on Jul. 29, 2021, now Pat. No. 11,523,693.

(60) Provisional application No. 63/059,249, filed on Jul. 31, 2020.

(51) Int. Cl.
*A47G 1/10* (2006.01)
*A47G 1/06* (2006.01)

(52) U.S. Cl.
CPC ..... *A47G 1/10* (2013.01); *A47G 2001/0677* (2013.01)

(58) Field of Classification Search
CPC ..... A47G 1/10; A47G 2001/0677; A47G 1/0605; A47G 2001/0694
See application file for complete search history.

(56) References Cited

U.S. PATENT DOCUMENTS

| | | | |
|---|---|---|---|
| 491,374 | A | 2/1893 | Robinson |
| 1,463,150 | A | 7/1923 | Carisen |
| 2,155,729 | A | 4/1939 | Mainieri |
| 2,470,416 | A | 5/1949 | Silver |
| 2,523,383 | A | 9/1950 | Maj Krzak |
| 2,567,743 | A | 9/1951 | Stafford et al. |

(Continued)

FOREIGN PATENT DOCUMENTS

| | | |
|---|---|---|
| DE | 199 00 831 | 5/2000 |
| EP | 1149550 | 10/2001 |

(Continued)

OTHER PUBLICATIONS

"5 × 7 Double Picture Frame for Tabletop, Slide in Rear Backer—Silver" (DISPLAYSZGO) Nov. 17, 2015 (Nov. 17, 2015); retrieved from internet Apr. 6, 2018; <https://web.archive.org/web/20151117081709/https://www.displays2go.com/P-12957/Metal-Picture-Frame-Displays-Two-5-x-7-Prints>; entire document.

*Primary Examiner* — Gary C Hoge
(74) *Attorney, Agent, or Firm* — Leason Ellis LLP

(57) ABSTRACT

A frame system according to one embodiment includes a hollow outer frame element that includes a plurality of recesses formed along inner faces of walls of the outer frame element. The outer frame element further includes a plurality of ribs formed along the inner face and an inner landing that protrudes inwardly into a center opening of the outer frame element. The frame system also includes a back plate configured for insertion into the center opening. The back plate includes a plurality of locking ribs for reception within the plurality of recesses to generate a snap-fit attachment of the back plate to the hollow outer frame element.

19 Claims, 12 Drawing Sheets

(56) References Cited

U.S. PATENT DOCUMENTS

| | | | | |
|---|---|---|---|---|
| 2,806,309 | A * | 9/1957 | Goldberg | G03B 21/64 40/781 |
| 2,959,882 | A | 11/1960 | Krull | |
| 3,127,695 | A | 4/1964 | Driscoll | |
| 3,294,429 | A | 12/1966 | Halp | |
| 3,429,602 | A | 2/1969 | Dirilgen | |
| 3,529,653 | A | 9/1970 | Fey, Jr. | |
| 3,579,886 | A * | 5/1971 | Hughes | G09F 1/12 40/781 |
| 3,657,796 | A | 4/1972 | Gochnauer | |
| 4,018,260 | A | 4/1977 | Baslow | |
| 4,041,861 | A | 8/1977 | Alter | |
| 4,144,660 | A | 3/1979 | Lamb | |
| 4,197,686 | A | 4/1980 | Baslow | |
| 4,201,359 | A | 5/1980 | Baslow | |
| 4,286,400 | A | 9/1981 | MacPherson | |
| 4,348,826 | A | 9/1982 | Reim | |
| 4,432,152 | A * | 2/1984 | Daenen | A47G 1/142 40/781 |
| 4,451,997 | A | 6/1984 | Jones | |
| 4,485,574 | A | 12/1984 | Bennetot | |
| 4,637,147 | A | 1/1987 | Wolsey | |
| 4,762,076 | A | 8/1988 | Wakaizumi | |
| 5,012,601 | A * | 5/1991 | Garland | G09F 1/12 40/781 |
| 5,058,353 | A | 10/1991 | Gartner | |
| 5,075,991 | A | 12/1991 | Wenkman et al. | |
| 5,275,224 | A | 1/1994 | Morris | |
| 5,307,575 | A | 5/1994 | Ivansson et al. | |
| 5,466,086 | A | 11/1995 | Goto | |
| 5,502,906 | A | 4/1996 | Yamawaki | |
| 5,579,595 | A | 12/1996 | Dutton | |
| 6,138,741 | A | 10/2000 | Stobart | |
| 6,189,252 | B1 | 2/2001 | Dowzall | |
| 6,253,471 | B1 | 7/2001 | Strauh | |
| 6,347,466 | B1 | 2/2002 | Lackner | |
| 6,354,031 | B1 * | 3/2002 | Meur | G09F 1/12 40/781 |
| 6,722,096 | B2 | 4/2004 | Von Arx | |
| 6,729,057 | B1 | 5/2004 | Lu | |
| D491,374 | S * | 6/2004 | Bradford | G09F 1/12 D6/310 |
| 7,293,378 | B2 | 11/2007 | Bihr | |
| 7,735,541 | B2 | 6/2010 | Ocampo | |
| 8,793,910 | B2 | 8/2014 | Froio | |
| 8,936,065 | B1 | 1/2015 | Gillespie | |
| 9,402,488 | B2 | 8/2016 | Morrish | |
| 10,532,606 | B1 * | 1/2020 | Gray | A47G 1/0627 |
| 10,624,473 | B1 * | 4/2020 | Tsai | A47G 1/06 |
| 10,628,112 | B2 | 4/2020 | Hofmeister | |
| 2001/0014250 | A1 | 8/2001 | Plummer et al. | |
| 2003/0200712 | A1 | 10/2003 | Brownsell et al. | |
| 2004/0226208 | A1 | 11/2004 | Kownacki et al. | |
| 2005/0129460 | A1 | 6/2005 | Medcalf et al. | |
| 2007/0245650 | A1 | 10/2007 | Brown | |
| 2009/0031593 | A1 | 2/2009 | Kasuya | |
| 2010/0147471 | A1 | 6/2010 | Bull | |
| 2012/0090211 | A1 | 4/2012 | Price | |
| 2013/0067785 | A1 | 3/2013 | Davis | |
| 2013/0180142 | A1 | 7/2013 | Kressin | |
| 2013/0333851 | A1 | 12/2013 | Chen | |
| 2014/0352184 | A1 | 12/2014 | Hall | |
| 2015/0297001 | A1 | 10/2015 | Welch | |
| 2016/0296033 | A1 | 10/2016 | Feltrin | |
| 2017/0035221 | A1 * | 2/2017 | Huff | A47G 1/0605 |
| 2017/0151772 | A1 | 6/2017 | Spiro et al. | |
| 2018/0199736 | A1 | 7/2018 | Spiro et al. | |
| 2019/0350387 | A1 * | 11/2019 | Bastian | A47G 1/1626 |
| 2020/0060444 | A1 * | 2/2020 | Katz | A47G 1/0627 |
| 2020/0397159 | A1 * | 12/2020 | Haney | A47G 1/06 |
| 2020/0397160 | A1 | 12/2020 | Spiro et al. | |

FOREIGN PATENT DOCUMENTS

| | | |
|---|---|---|
| FR | 2 609 615 | 7/1988 |
| GB | 1 334 851 | 10/1973 |
| JP | 40-6073 | 2/1965 |
| JP | 49-19648 | 2/1974 |
| JP | 50-19535 | 3/1975 |
| JP | S95-271800 | 11/1987 |
| JP | S63 197585 | 12/1988 |
| JP | 09-263100 | 10/1997 |
| JP | 2003306000 | 10/2003 |
| JP | 2006001282 | 1/2006 |
| JP | 2008-194194 | 8/2008 |
| JP | 2009153680 | 7/2009 |
| WO | WO 2007/123394 | 11/2007 |
| WO | WO 2012/076370 | 6/2012 |

* cited by examiner

SNAP-FIT FRAMING SYSTEM

CROSS-REFERENCE TO RELATED PATENT APPLICATIONS

This application is a continuation of U.S. Non-Provisional patent application Ser. No. 17/388,762, filed Jul. 29, 2021, which is based on and claims priority to U.S. Provisional Patent Application 63/059,249, filed Jul. 31, 2020, the entire contents of which is incorporated by reference herein as if expressly set forth in its respective entirety herein.

TECHNICAL FIELD

The present disclosure is directed to a frame for displaying an object, such as a photograph or artwork, and more particularly, relates to a snap-fit framing (frame) system or assembly.

BACKGROUND

Frames have been used for many years to hold and display an object, such as artwork, a photo, etc. Traditionally, frames were formed of wood pieces that are attached to together at the corners of the frame. This type of construction and assembly was time consuming and costly. There is therefore a need for an alternative frame that is easy to assembly and provides additional features that improve the quality of the framed article and the framing experience.

SUMMARY

A frame system according to one embodiment includes a hollow outer frame element that includes a plurality of recesses formed along inner faces of walls of the outer frame element. The outer frame element further includes a plurality of ribs formed along the inner face and an inner landing that protrudes inwardly into a center opening of the outer frame element. The frame system also includes a back plate configured for insertion into the center opening. The back plate includes a plurality of locking ribs for reception within the plurality of recesses to generate a snap-fit attachment of the back plate to the hollow outer frame element.

BRIEF DESCRIPTION OF THE DRAWING FIGURES

DETAILED DESCRIPTION OF CERTAIN EMBODIMENTS

Figure 11:
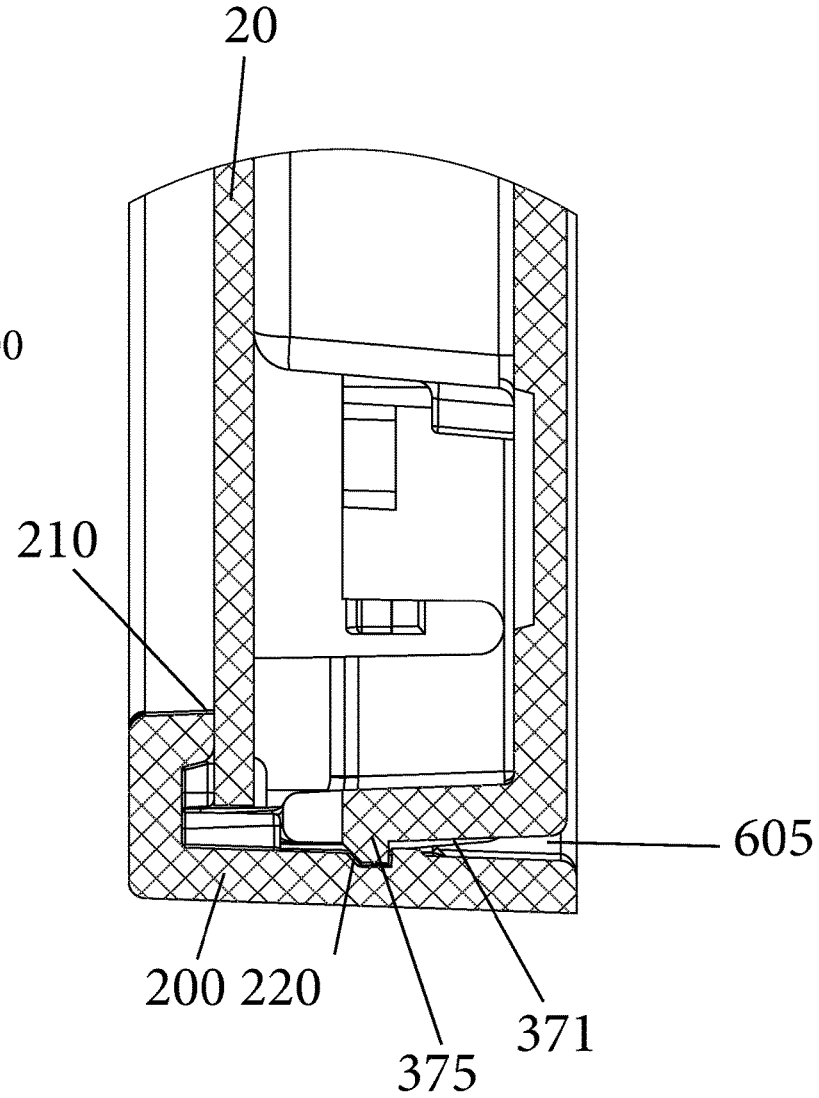
FIG. 11 is an enlarged view of an end portion taken along the circle of FIG. 10.
Figure 13:
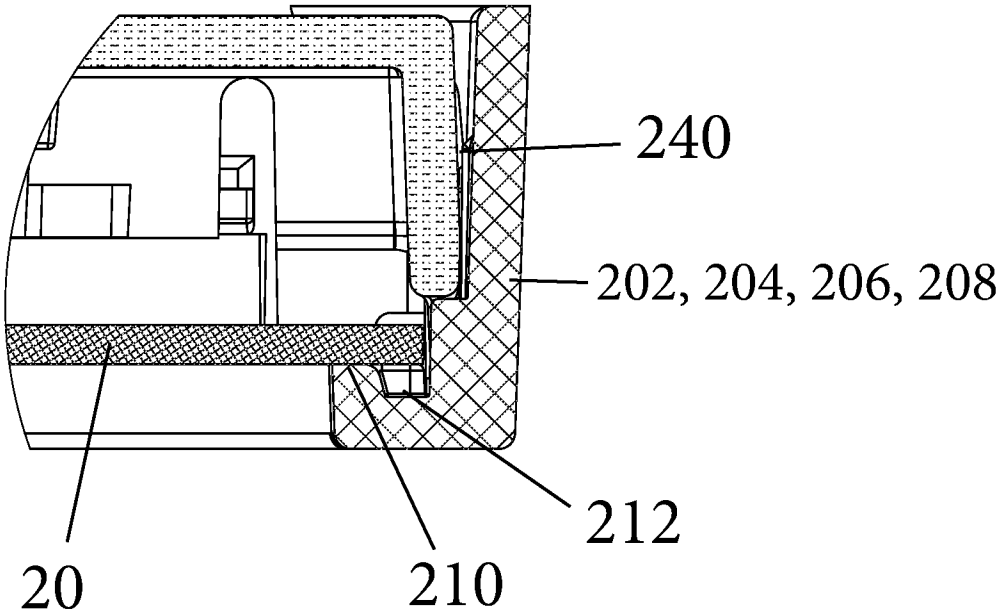
FIG. 13 is yet another enlarged view of another cross-section of the back plate.

In accordance with the present disclosure, as illustrated in FIGS. 1-17, a framing system or assembly (kit) 100 is shown and described and is configured to create a framed article that can be displayed either on a wall or can stand upright on a flat surface, such as a table or desk. The framed article is configured to display an image that is part of an image substrate 20 (FIG. 3) that is held and displayed within the framing system 100. The image substrate 20 is typically a rigid substrate on which an image is displayed. While the image substrate 20 is illustrated in FIG. 11 as a single layer, it will be appreciated that the image substrate 20 can include more than one layer, such as a rigid backing layer and a photo layer or the like. The image displayed can take any number of different forms including a paper clipping, a photo, artwork including a painting, or other artistic expression.

As described herein, the framing system 100 provides an easy to use and easy to assemble kit that allows a user to assemble the frame and position and retain the image substrate therein. The framing system 100 has other accessories to allow it to be displayed in different ways, such as hanging on a wall or displayed on a flat table surface, etc.

The framing system 100 has two main parts, namely, an outer frame element (first part) 200 and a back plate 300 (second part) that mates with the outer frame element 200 to form the assembled frame. As described herein, the outer frame element 200 and the back plate 300 are attached to one another with a mechanical fit and more particularly, can snap-fittingly mate with one another.

The outer frame element 200 is a hollow piece that has a main body that defines a hollow center opening 205. The outer frame element 200 can have any number of different shapes and sizes based on the intended shape and size of the framed article 10. The main body of the outer frame element 200 has a plurality of (e.g., four) interconnected walls 202, 204, 206, 208. The illustrated main body has a square shape and therefore, each of the interconnected walls 202, 204, 206, 208 can be in the form of a rail or the like. Each of the walls 202, 204, 206, 208 has an outer surface 201 and an inner surface 203. The illustrated outer surface 201 represents the portion of the frame system 100 that is readily visible and therefore, it can be smooth or it can have a decorative finish (and thus is not limited to being a smooth surface).

Outer Frame Element 200

The outer frame element 200 includes a plurality of recesses 220 that are formed along the inner surface 203. As illustrated, there can be two recesses 220 formed along each of the walls 202, 204, 206, 208. For example, one recess 220 can be formed near one end of the respective wall, while the other recess 220 can be formed near the other end. The recesses 220 can be centrally located along the respective walls 202, 204, 206, 208 or the recesses 220 can be located closer to a rear edge 211 of the respective wall. The rear edge 211 is the edge that faces rearward when the frame system 100 is displayed in an intended manner. As shown in FIG. 11, the recess 220 can have a forward beveled edge and a flat rear edge, with the forward beveled edge being further from the rear edge 211 compared to the flat rear edge of the recess 220 which can be thought of as defining a shoulder.

Figure 5:
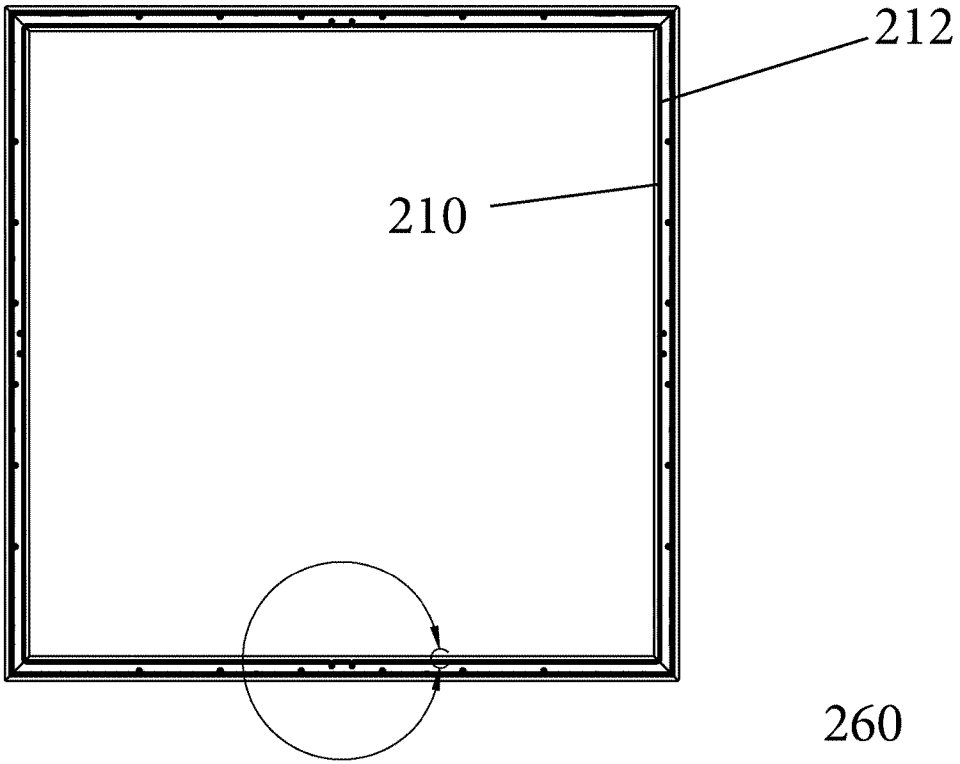
FIG. 5 is a rear elevation view of the outer frame element without the image substrate.

The outer frame element 200 also includes a plurality of protrusions (e.g. ribs) that are formed along the inner surface 203. As shown in FIG. 5, the plurality of protrusions comprises two or more sets of different protrusions formed along each of the walls 202, 204, 206, 208. For example, a set of first protrusions (ribs) 240 is provided; a set of second protrusions (ribs) 250 is provided; and a set of third protrusions (ribs) 260 is provided. Each first protrusion 240 is formed along the inner surface 203 and extends upwardly from an inner landing 210 that extends around the inner surface 203.

The first protrusions 240 are elongated structures each having a first length. In the illustrated embodiment, there are two first protrusions 240 that are spaced along the length of each wall 202, 204, 206, 208. The first protrusions 240 extend towards but do not reach the rear edge 211. As shown, all of the first protrusions 240 associated with each of the walls 202, 204, 206, 208 can be located between the two recesses 220 formed along the respective wall 202, 204, 206, 208. The first protrusions 240 are integrally formed along the inner surface of the walls 202, 204, 206, 208.

The second protrusions 250 are elongated structures each having a second length. In the illustrated embodiment, there are six second protrusions 250 that spaced along the length of each wall 202, 204, 206, 208. The second protrusions 250 extend towards but do not reach the rear edge 211. As shown, all of the second protrusions 240 associated with each of the walls 202, 204, 206, 208 can be located between the two recesses 220 formed along the respective wall 202, 204, 206, 208. The second protrusions 250 are integrally formed along the inner surface 203 of the walls 202, 204, 206, 208.

The second length is less than the first length and therefore, the first protrusions 240 are longer and extend further up the inner face of the walls 202, 204, 206, 208 compared to the second protrusions 250.

The inner landing 210 has a channel or groove 212 formed therein. The channel 212 preferably extends completely around the inner landing 210. The second protrusions 250 can have curved inner surfaces as shown in FIG. 6 and FIG. 6 also shows that the second protrusions 250 extend a greater distance into the channel 212 compared to the first protrusions 240.

Figure 4:
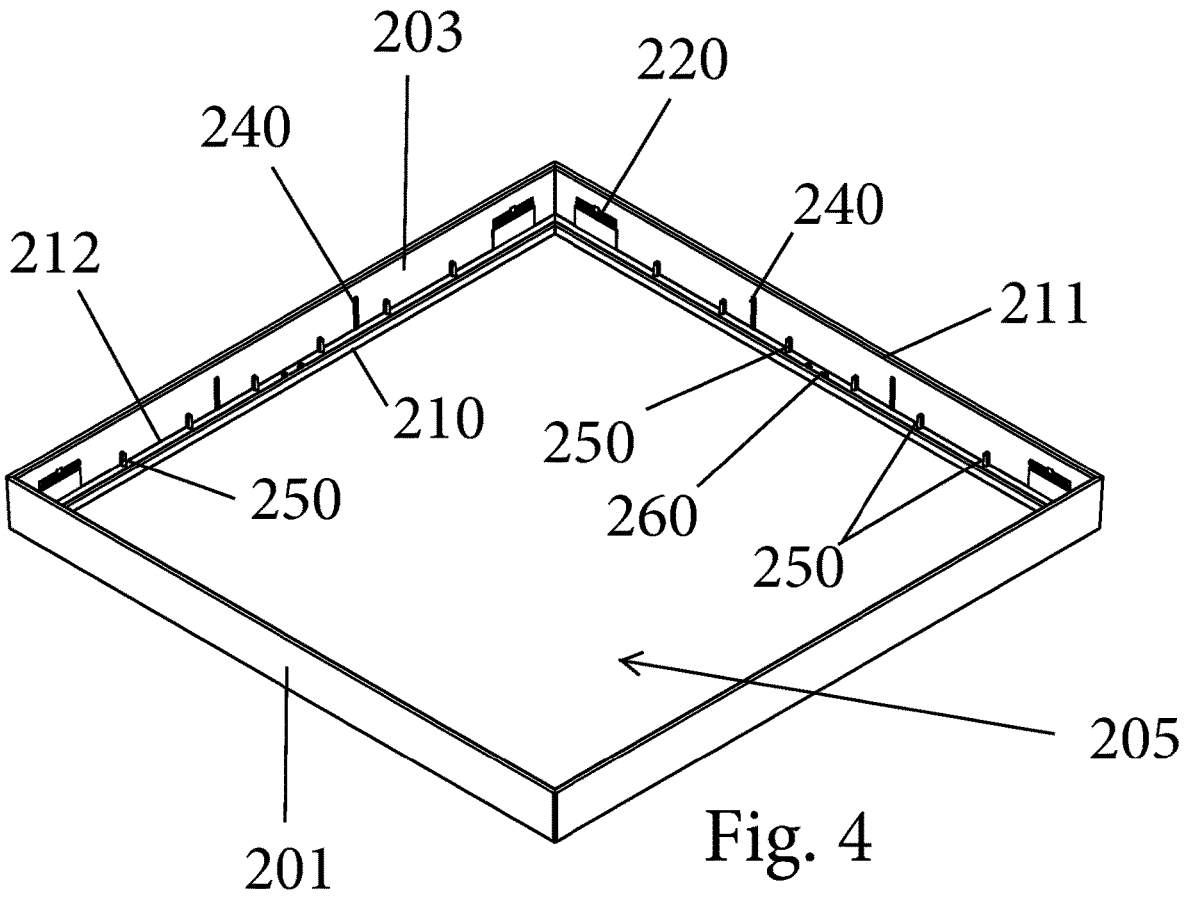
FIG. 4 is a rear perspective of the outer frame element without the image substrate.
Figure 6:
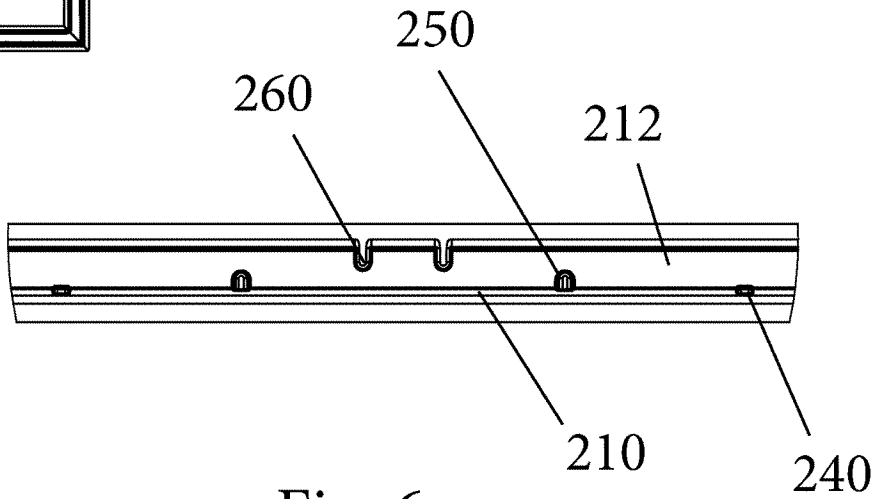
FIG. 6 is an enlarged view of a wall segment of the outer frame element taken along the circle in FIG. 5.

As shown in FIGS. 4-6, the third protrusions 260 can be formed along the inner landing 210 and are spaced from the inner surface 203. The second protrusions 250 can be in the form of bumps or elongated protrusions and extend in the direction toward the rear edge 211 much like the first and second protrusions 240, 250. Like the second protrusions 250, the third protrusions 260 extend into the channel 212. The third protrusion 260, like the second protrusion 250, can have a rounded (curved) surface. The second protrusions 250 and third protrusions 260 can generally have a pill shape or partial pill shape as shown.

The third protrusions 260 have third lengths that are less than both the first lengths of the first protrusions 240 and the second lengths of the second protrusions 250. As best shown in FIG. 4, all of the protrusions 240, 250, 260 extend outwardly from the inner landing 210. The third protrusions 260 are located on one side (inner side) of the channel 212 and the first protrusions 240 and the second protrusions 250 are located on the other side (outer side) of the channel 212.

In the illustrated embodiment, there are two third protrusions 260 per each wall 202, 204, 206, 208. The two third protrusions 260 can be centrally located and be formed between a pair of second protrusions 250.

As described herein, the three sets of protrusions 240, 250, 260 have different functionality.

Each of the walls 202, 204, 206, 208 preferably has the same pattern of first, second and third protrusions 240, 250, 260.

Figure 3:
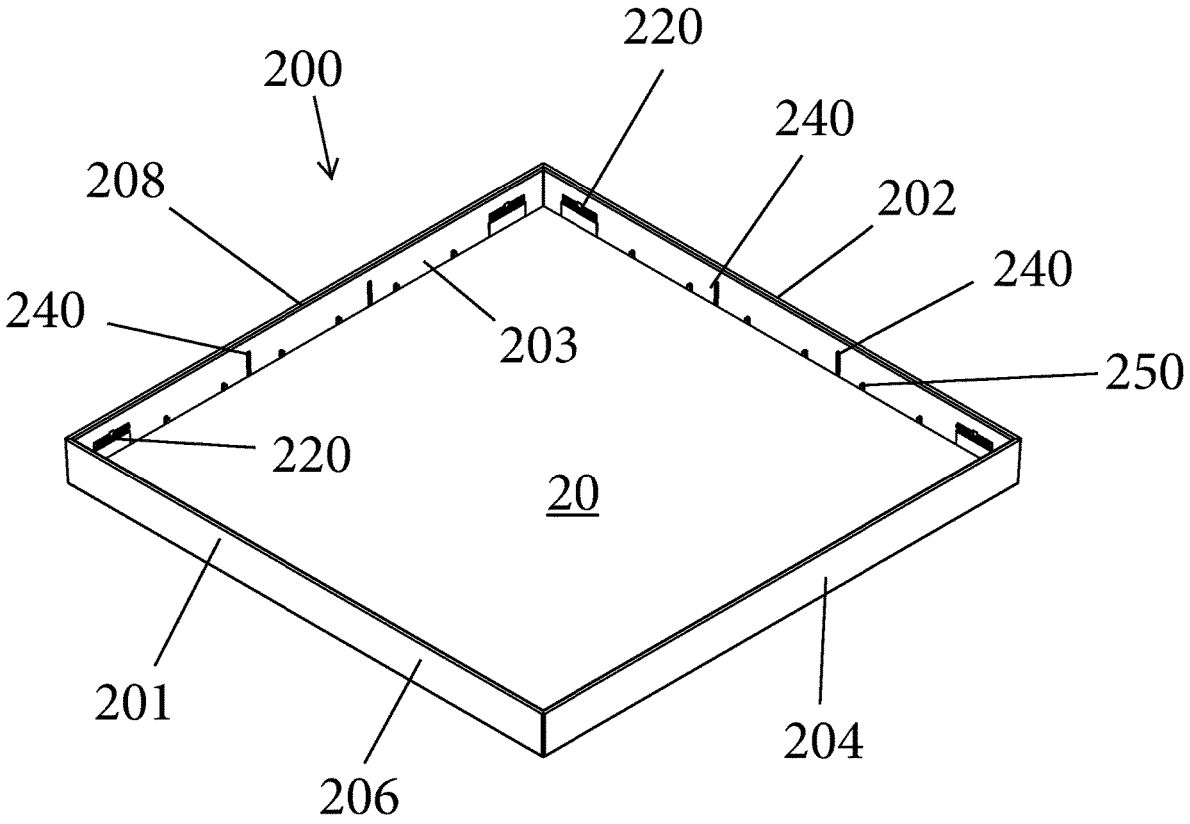
FIG. 3 is a rear perspective view of a first part (outer frame element) of the framed article with an image substrate being disposed within the outer frame element.

As described herein, the third protrusions 260 also serves as a surface against which the image substrate 20 is seated as shown in FIG. 3 in which the third protrusions 260 are not visible since they lie below the image substrate 20. One feature of the inner surfaces of the second protrusions 250 is to locate the outer edge of the image substrate 20. As shown in FIG. 3, when the image substrate 20 is inserted into the outer frame element 200, the outer edge of the image substrate 20 contacts and seats against the second protrusions 250. In other words, the second protrusions 250 serves to align the image substrate 20 within the framing system 100. The tops of the second protrusions 250 also serve as secondary stops that prevent the back plate 300 from being pushed into the outer frame element 200 (in a direction toward the image substrate 20).

As also described herein, the first protrusions 240 act as bumper guards and they prevent the back plate 300 from shifting inside of the outer frame element 200. In addition, the first protrusions 240 help keep the snap-fit attachment intact between the outer frame element 200 and the back plate 300.

As mentioned, the back plate 300 is configured to be inserted into and mate with the outer frame element 200 and more particularly, according to one embodiment, a snap-fit connection is achieved between the outer frame element 200 and the back plate 300 as described herein.

The outer frame element 200 can be formed of any number of suitable materials including suitable plastics (e.g., injection molded plastics).

Back Plate 300

The back plate 300 serves as the rear part of the frame assembly 100 that is located behind the image substrate 20 and the engagement of the back plate 300 to the outer frame element 200 serves to capture and hold the image substrate 20 between the back plate 300 and the outer frame element 200.

As mentioned, the back plate 300 attaches to the outer frame element 200 and closes off the back of the frame system 100. As also described herein, the image substrate 20 is disposed and held between the back plate 300 and the outer frame element 200 and more particularly, the user places the image substrate onto the inner landing 210 and then attaches the back plate 300 to the outer frame element 200, thereby capturing the image substrate 20 therebetween.

As shown, the back plate 300 is inserted into the hollow opening of the outer frame element 200 with locking features of the back plate 300 engaging locking features of the outer frame element 200 to form a snap-fit. The back plate 300 has a complementary shape to the outer frame element 200 and therefore, in the illustrated embodiment, the back plate 300 is square shaped.

Figure 7:
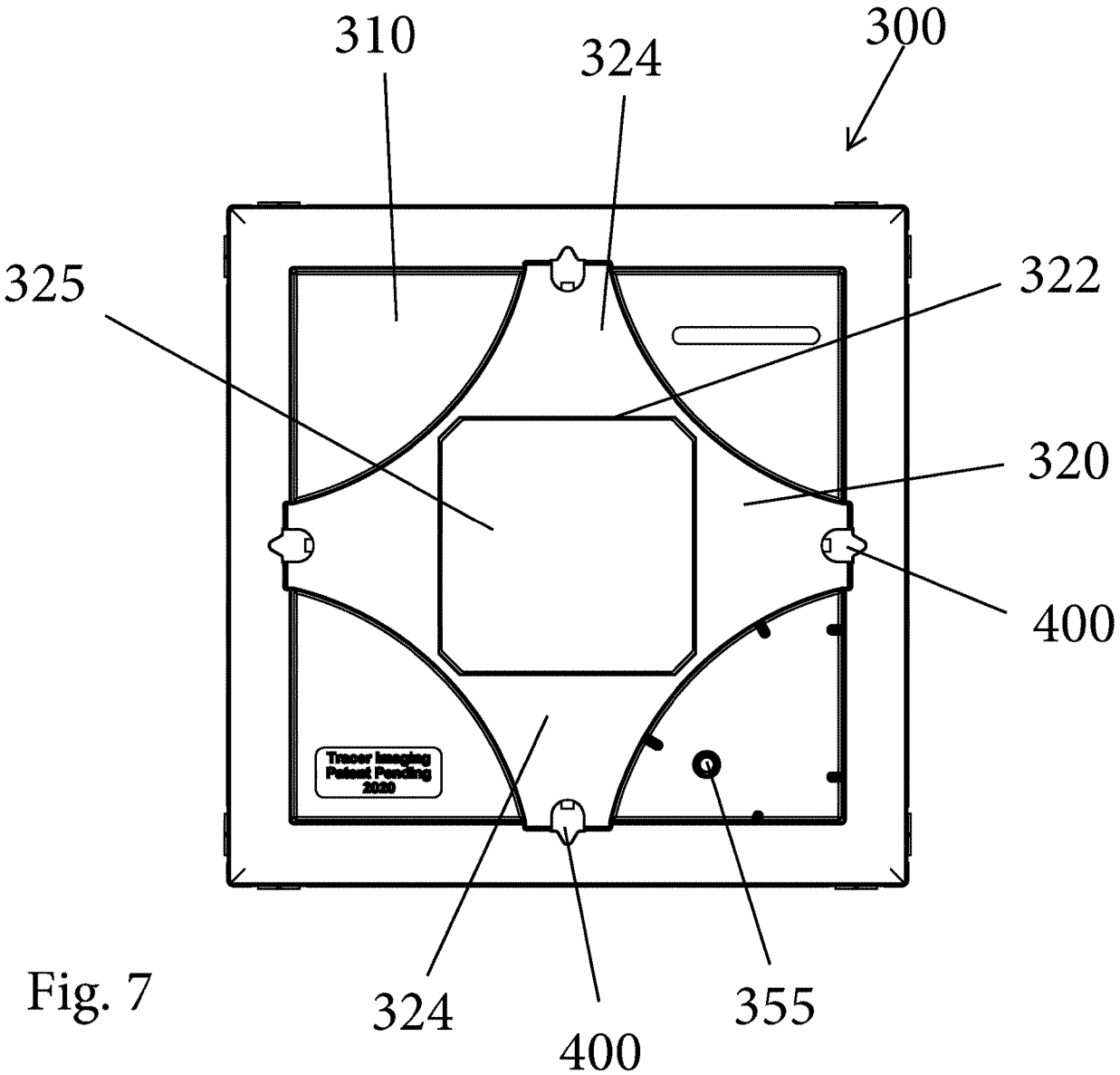
FIG. 7 is a rear elevation view of a second part (back plate) of the framed article without the kickstand.
Figure 8:
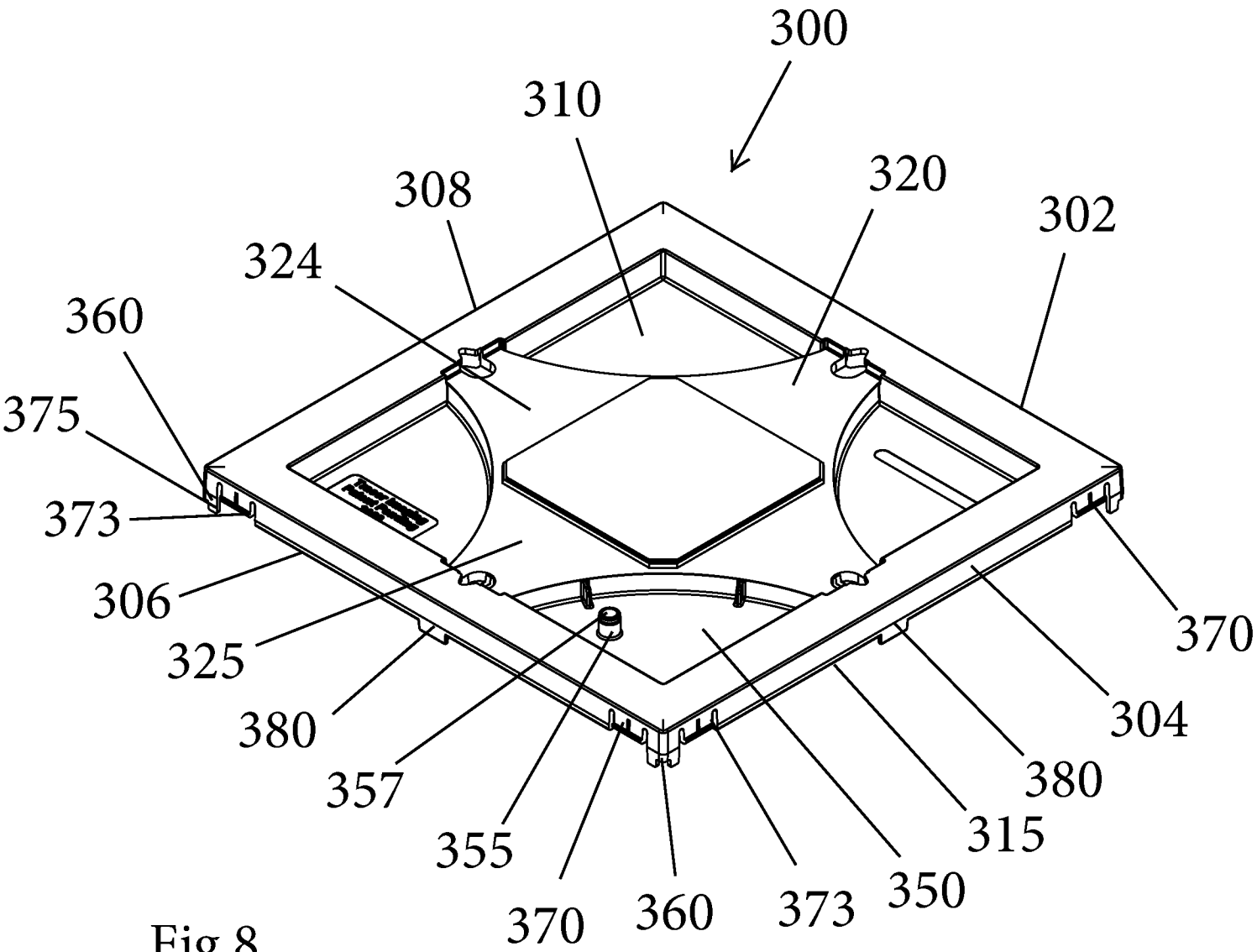
FIG. 8 is a rear perspective view of the back plate.

As best shown in FIGS. 7 and 8, the back plate 300 has a first wall 302, a second wall 304, a third wall 306, and a fourth wall 308 that are all interconnected to one another. Between the first wall 302, the second wall 304, the third wall 306, and the fourth wall 308, an inner wall 310 is provided and extends between these walls. The inner wall 310 is thus designed to completely seal off the inner space between the walls 302, 304, 306, 308. The inner wall 310 has a front face that faces and contacts the image substrate 20 and an opposite rear face of the inner wall 310 faces away from the inner wall 310.

Along the inner wall 310 there is a raised platform 320 that protrudes outwardly (rearwardly) from the inner wall 310. The raised platform 320 has a center portion 322 and a plurality of leg portions 324 that extend from the center portion 322 to each of the walls 302, 304, 306, 308. Each of the leg portions 324 is defined by a curved (sloped) edge 326. In the illustrated embodiment, there are four leg portions 324 and thus, four curved edges 326. Between each curved edge 326 and one respective corner of the back plate 300, there is a corner space 350 that has a wedge shape.

Figure 1:
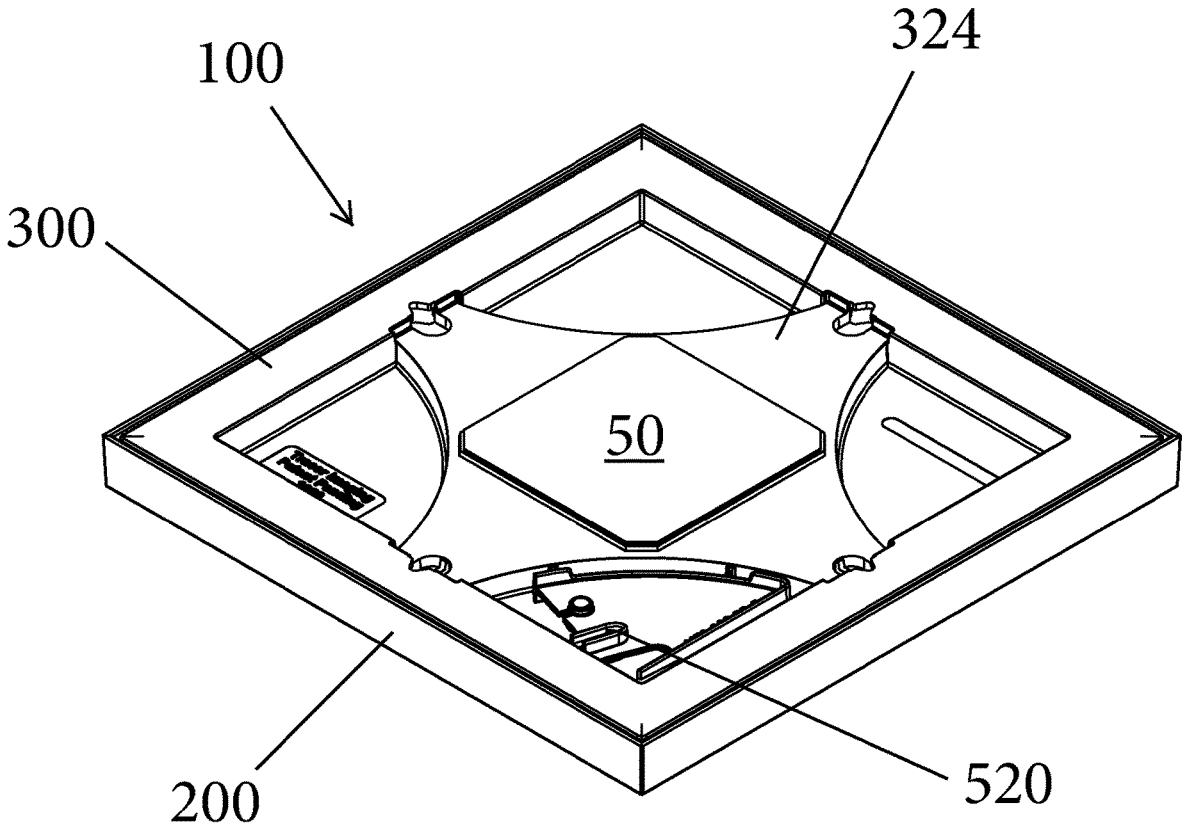
FIG. 1 is a rear and side perspective view of a framed article in accordance with one embodiment.

Within the center portion 322 of the raised platform 320 there can be a raised pad 325 that provides a surface on which mounting hardware can be secured. The mounting hardware is generally illustrated in FIG. 1 at element 50. The mounting hardware 50 can take any number of different forms that are configured to attach the back plate 300 to a support surface, such as a wall. For example, the mounting hardware 50 can take the form of a square of double-sided tape or it can be in the form of a metal element (metal layer or plate). Preferably, the mounting hardware seats flush against the raised pad 325.

As shown the raised pad 325 can have a square shape with the corners of the raised pad 325 being located close to the curved edges 326 of the raised platform 320. The raised pad 325 thus serves to centrally locate the mounting hardware on the rear of the back plate 300.

At the interface between each leg portion 324 and the side wall 302, 304, 306, 308, there is an opening (mounting opening) 400 that is configured to receive a fastener or a stand to assist in mounting the framed article to a wall or the like or to allow the framed article to stand upright on a flat surface, such as a table. The opening 400 has an inner edge 402 that is curved and an opposite outer edge 403 in the form of a concave notch that is formed in one of the walls 302, 304, 306, 308. A fastener, such as a nail, can be received within the concave notch as a way to hang the framed article on the fastener. The fastener can be inserted into a wall for hanging the framed article onto the wall. The use of opening 400 to receive a kickstand for allowing the framed article to stand upright on a table is described herein.

Figure 12:
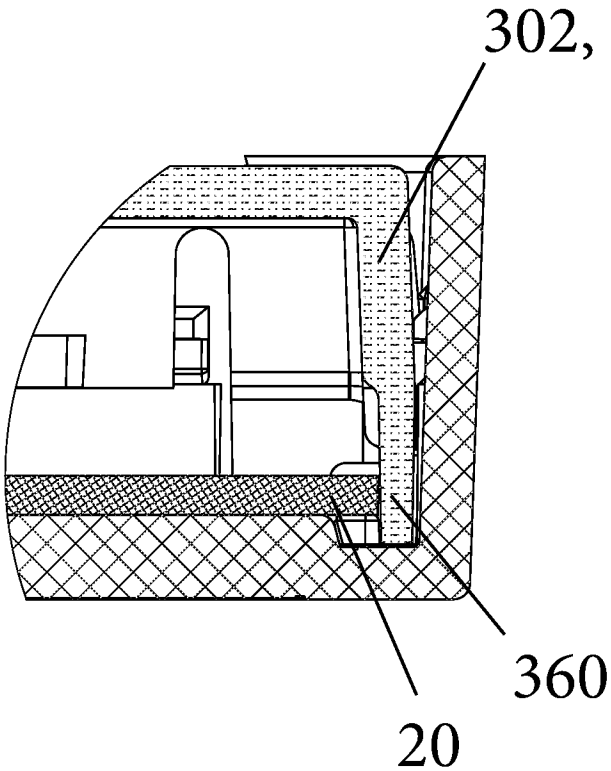
FIG. 12 is another enlarged view of another cross-section of the back plate.

As previously mentioned, the back plate 300 snap-fittingly attaches to the outer frame element 200 and therefore includes locking features that mate with complementary locking features of the outer frame element 200. For example, the back plate 300 includes a plurality of corner guides 360 best shown in FIG. 8. The corner guides 360 are in each corner and are L-shaped in that one wall of the corner guide 360 is located along one wall of the back plate 300 and the other wall of the corner guide 360 is located along the other wall of the back plate 300 that defines the corner. Each of the walls 302, 304, 306, 308 of the back plate 300 terminates in a forward edge 315. The walls of the corner guide 360 extend beyond the forward edge 315 in that the walls of the corner guide 360 have greater length (height) than the other sections of the walls 302, 304, 306, 308. The corner guide 360 is configured to be received within the channel 212 formed in the landing 210 as shown in FIG. 12. There are therefore four corner guides 360 in the illustrated back plate 300. As also shown in FIG. 12, the image substrate 20 lies partially over the channel 212 with the corner guide 360 being adjacent and in contact with the image substrate since the corner guide 360 is disposed within the channel 212 and can be in contact with the floor of the channel 212. FIG. 12 shows that the corner guide 360 disposed between the outer edge of the image substrate 20 and the respective outer wall 202, 204, 206, 208.

An additional locking feature of the back plate 300 comprises a plurality of locking ribs 370 that are configured to be received into and engage the recesses 220 that comprise the complementary locking features of the outer frame element 200. More particularly, the locking ribs 270 snap-fittingly mate with the recesses 220 to interlockingly couple the back plate 300 to the outer frame element 300.

Each locking rib 370 comprises a flexible rib that is defined between two slots 371 formed in the wall 302, 304, 306, 308 to allow the locking rib 370 to flex. At a forward end of the locking rib 370 an outwardly directed lip 375 is formed. The lip 375 is integrally formed with the rest of the locking rib 370. As best shown in FIG. 11, the lip 375 has a complementary shape as the recess 220 in that it includes a beveled edge that seats against the beveled surface of the recess 220 and a flat edge that seats against the flat surface of the recess 220. In FIG. 11, the locking rib 370 is snap-fittingly received into one respective recess 220. The reception of the locking ribs 370 into corresponding recesses 220 results in a secure snap-fit being achieved between the outer frame element 200 and the back plate 300.

There are two locking ribs 370 located along each side wall 302, 304, 306, 308 and in particular, the two locking ribs 370 are located near or at the ends of the respective wall 302, 304, 306, 308. Thus, in each corner of the framed article, there is one corner guide 360 disposed between two locking ribs 370. This leads to the main securement between the outer frame element 200 and the back plate 300 being located in the corners of the framed article.

As shown in the figures, including FIG. 11, the locking rib 370 has a local area of increased thickness and in particular, the local area can be in the form of a rail 371 or other protrusion that bulges slightly outward from the rest of the locking rib 370. It will be appreciated that each of the two locking ribs 370 that define each corner has one rail 371. As shown in FIG. 11, the rail 371 does not extend the entire height of the locking rib 370.

As shown in FIG. 8, there is a center tab 380 that is located along the wall 302, 304, 306, 308. The center tab 380 also extends beyond the forward edge 315. The center tab 380 is located between the two locking ribs 370 located along the same wall 302, 304, 306, 308. The center tab 380 is designed, in combination with the third protrusions 260, to prevent an outward bowing of the framed article after assembly (i.e., outward flexing of the outer frame element 200). The center tab 380 opposes the third protrusion 260. More specifically, each center tab 380 is disposed outside of and in contact with one respective pair of the third protrusions 260. The center tabs 380 are thus located between the third protrusions 260 and the walls 202, 204, 206, 208 of the outer frame element 200 and since the center tab 380 is significantly more rigid than the hollow outer frame element 200, the center tabs 380 which are located outside (along the outer face) of the outer frame element 200 prevents any deformation and outward bowing of the hollow outer frame element 200.

Assembly of Frame System 100

As mentioned, the frame system 100 is assembled to achieve a mechanical (snap-fit) between the outer frame element 200 and the back plate 300.

First, the image substrate 20 is placed within the hollow outer frame element 200 and rests on the inner landing 210 that is formed along the inner periphery of the outer frame element 200. The rear plate 300 is then inserted into the center opening 205 of the hollow outer frame element 200. The corner guides 360 are received within the channel 212 formed in the landing 210 as shown in FIG. 12 and the rigid center tabs 380 are positioned outside of and adjacent the third protrusions 260.

Figure 17:
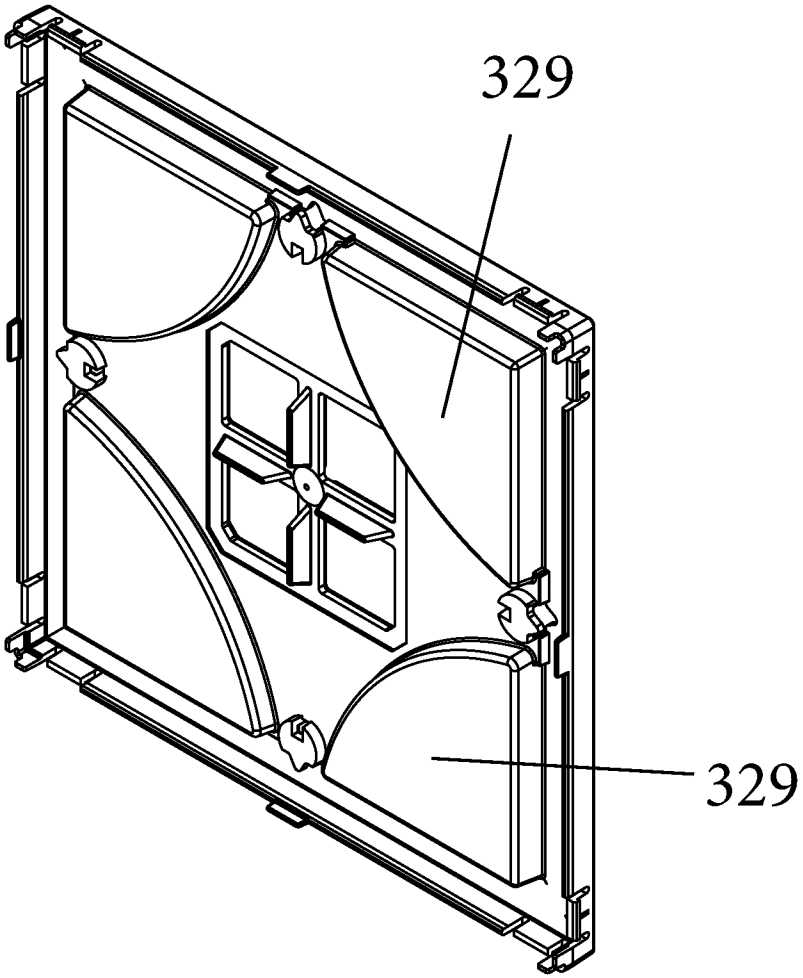
FIG. 17 is a front perspective view of the back plate.

As shown in FIG. 17, a plurality of raised platforms 329 are provided along the inner face of the back plate 300 on which the image substrate 20 rests. As shown, there are four platforms 329 on which the four corner regions of the image substrate 20 rests to ensure proper positioning and proper support of the image substrate 20 (the raised platforms 329 provide proper backing and push the image substrate 20 forward). The raised platforms 329 can be generally wedge shaped or triangular shaped as shown.

The snap-fit between the outer frame element 200 and the back plate 300 is achieved by inserting the locking ribs 370 into the (locking) recesses 220. As shown in the figures, this results in the image substrate 20 being captured between the outer frame element 200 and the back plate 300. The corner guides 360 serve also as a self-aligning feature for the image substrate 20.

FIGS. 9-13 illustrate the details of how the outer frame element 200 snap-fits with the back plate 300 and the relative position of the image substrate 20.

Kickstand

Figure 9:
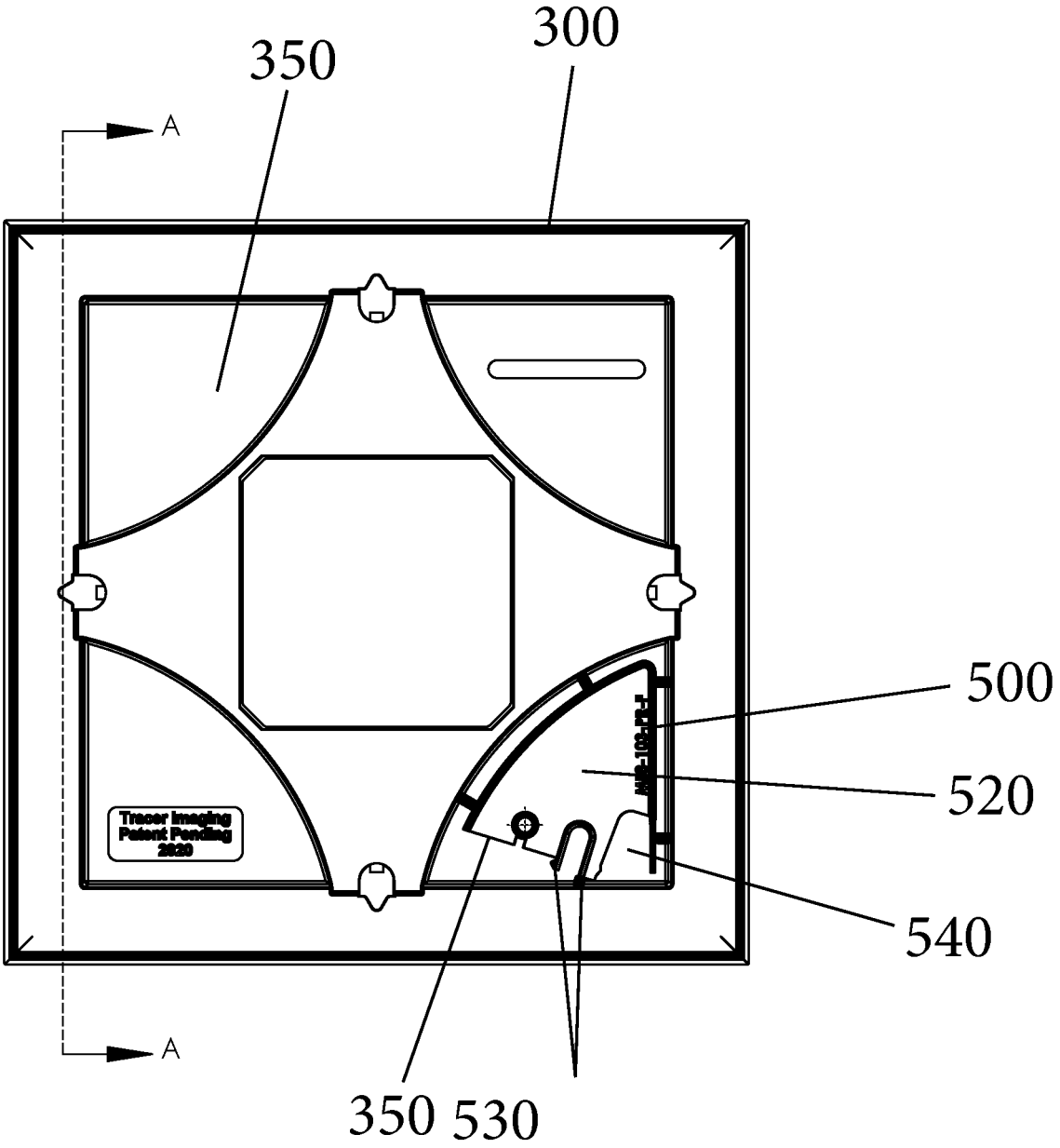
FIG. 9 is a rear elevation view of the back plate showing the kickstand secured thereto.
Figure 10:
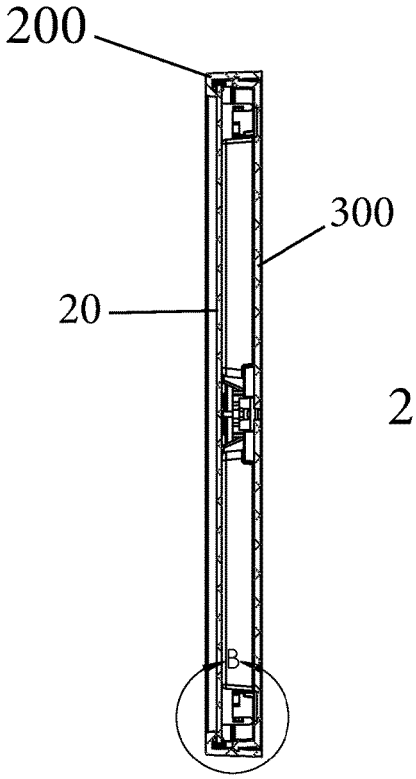
FIG. 10 is a cross-sectional view taken along the line A-A of FIG. 9.
Figure 14:
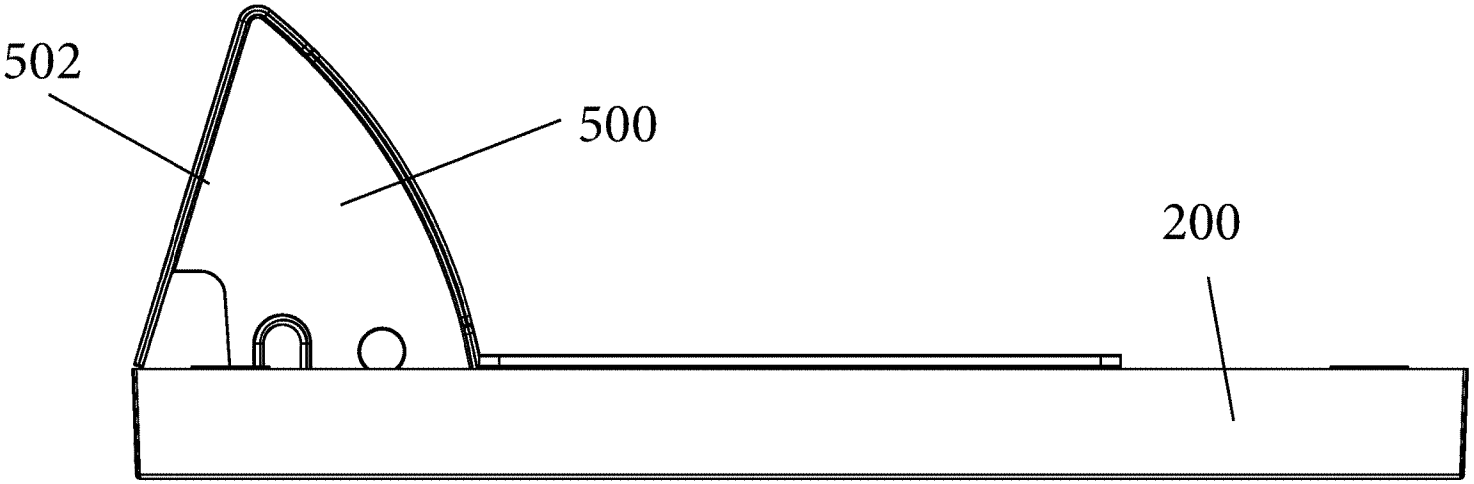
FIG. 14 is a side elevation view of the assembled frame article with a kickstand in an attached position.
Figure 15:
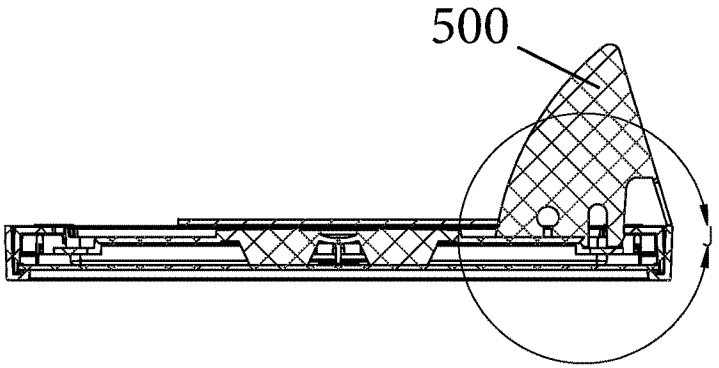
FIG. 15 is a cross-sectional view thereof.
Figure 16:
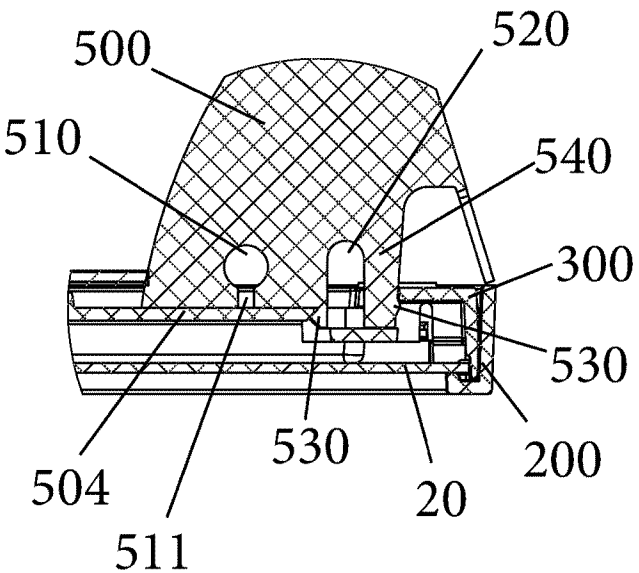
FIG. 16 is an enlarged view of the kickstand taken along the circle of FIG. 15.

In yet another aspect of the present disclosure best shown in FIGS. 14-16, a kickstand 500 can be provided. As mentioned, the back plate 300 includes a plurality of corner spaces 350 (FIG. 9). One of the corner spaces 350 serves as a kickstand storage space. Within the corner space 350, there is a post 355 that protrudes upwardly from the floor of the corner space 350 as shown in FIG. 8. The post 355 has an undercut 357 formed therealong.

Figure 2:
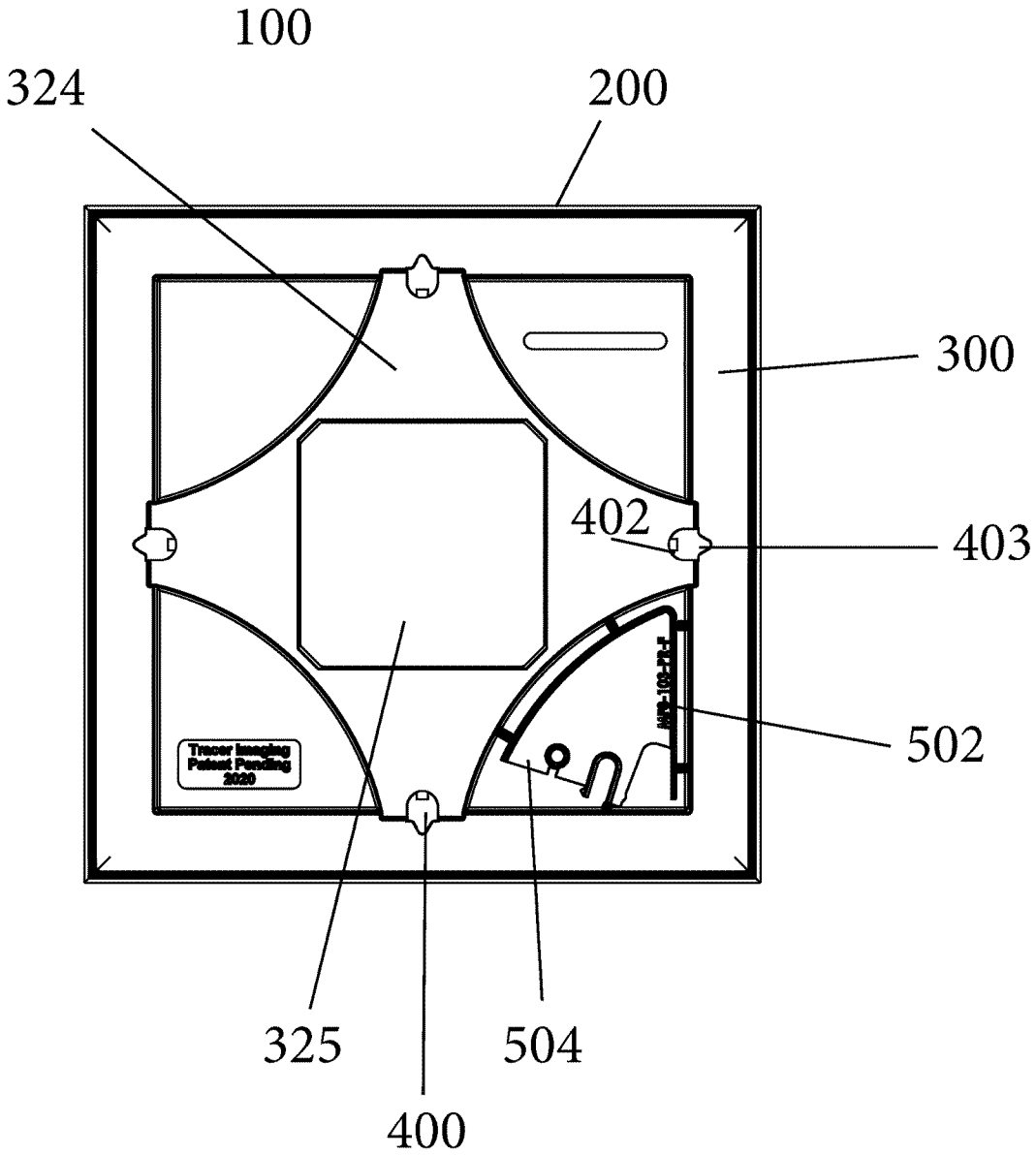
FIG. 2 is a rear view of the framed article.

As shown in FIGS. 1 and 2, the kickstand 500 has a curved body with a first end 502 and an opposite second end 504. The first end 502 is a flat surface that is positioned along the support surface, such as a table. As shown in FIG. 16, the body of the kickstand 500 also includes an opening 510 with a slot 511 that extends from the opening 510 to the second end 504. The opening 510 receive the post 355 resulting in a snap-fit between the post 355 (due to the undercut 357 thereof) and the kickstand 500 for temporary storage of the kickstand 500. When the user is ready to use the kickstand 500, the kickstand 500 is removed from the post 355.

The kickstand 500 also includes a slot 520 that defines a pair of locking snap-fit elements (e.g., locking tabs or catches) 530. The snap-fit elements 530 are located and the end of two flexible prongs 540 that protrude outwardly from the second end 504. These flexible prongs 540 are intended to be received within one opening 400 formed in the back plate 300 to achieve a snap fit between the kickstand 500 and the back plate 300. As mentioned, the opening 400 has opposing edges to which the snap-fit element 530 can engage in a snap-fit manner. The flexible poring 540 allow for the snap-fit elements 530 to be initially received into the opening 400 and then flex outwardly into complementary locking edges formed in the opening 400.

The snap-fit elements 530 of the two flexible prongs 540 engage the edges of the opening 400 to cause a snap-fit engagement between the kickstand 500 and the back plate 300. As mentioned, when the kickstand 500 is inserted into the opening 400, the first end 502 faces downward and seats against the flat support surface (table surface).

Since there are four openings 400, the kickstand 500 can be inserted into any one of the four openings 400.

Disengagement Tool 600

Figure 18:
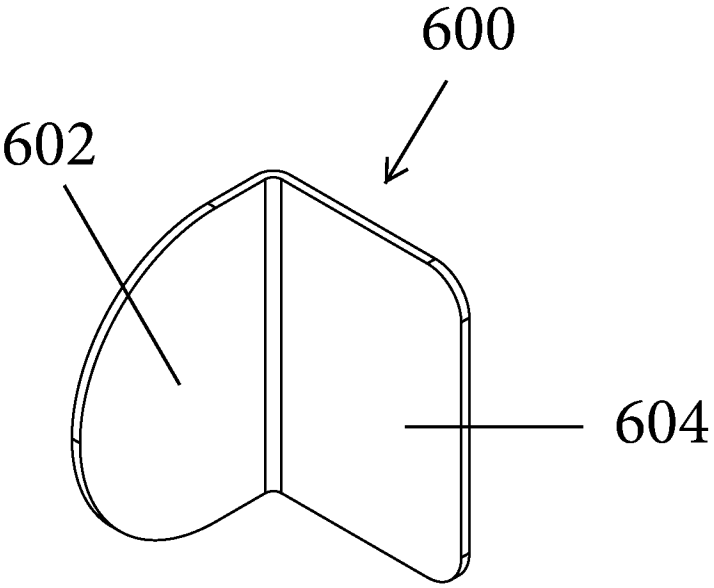
FIG. 18 is a perspective view of a disengagement tool.

In one aspect of the present invention shown in FIG. 18, a disengagement tool 600 can be used to easily disengage the outer frame element 200 from the back plate 300. As shown, the disengagement tool 600 can be in the form of a curved card-like structure and more particularly, can comprise a 90 degree body defined by a two legs 602, 604. The shape and size of the tool 600 are selected in view of the dimensions of the frame assembly 100.

The 90 degree disengagement tool 600 is inserted into a space 605 (FIG. 11) that is formed between the locking rib 370 and one of the respective walls 202, 204, 206, 208 when the lip 375 is engaged with the recess 220 which results in the outer frame element 200 and the back plate 300 being coupled and engaged with one another. When the tool 600 is pressed down into the space 605 it encounters the rails 371 of the two locking ribs 370 that are formed at 90 degree angles and further movement of the tool 600 and increased contact with the rails 371 causes inward flexing of the locking ribs 370 and disengagement of the lips 375 from the respective recesses 220, thereby freeing the respective corner of the framing system 100.

The disengagement tool 600 has two legs that are formed at 90 degrees since for the corner of the framing system 100 will not easily disengage unless both side walls of the corner disengage at the same time. If the disengagement tool 600 only had one leg and was inserted into only one space 605, the corner will not easily disengage. As a result, the disengagement tool 600 has two legs and has a card-like construction.

As mentioned, to use the disengagement tool 600, the user simply inserts the bottom edge of the tool 600 into the space 605 and then pushes down until the bottom edge of the tool 600 contacts and rides over the two rails 371 causing inward flexing of the locking ribs 370 to disengage the locking ribs 370 from the recesses 220.

Once one corner of the framing system 100 becomes disengaged, the entire outer frame element 200 can be fairly easily removed. Alternatively, each corner of the framing system 100 can be disengaged using the disengagement tool 600.

It is to be understood that like numerals in the drawings represent like elements through the several figures, and that not all components and/or steps described and illustrated with reference to the figures are required for all embodiments or arrangements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not precludes the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. A frame system for holding an image substrate comprising:

a hollow outer frame element that includes a plurality of recesses formed along inner faces of walls of the outer frame element, the outer frame element further including a plurality of ribs formed along the inner face and an inner landing that protrudes inwardly into a center opening of the outer frame element; and a back plate configured for insertion into the center opening, the back plate including a plurality of locking ribs for reception within the plurality of recesses to generate a snap-fit attachment of the back plate to the hollow outer frame element;

wherein the back plate includes a raised platform that defines corner areas that are recessed relative to the raised platform, the raised platform including a raised pad that comprises mounting hardware for mounting the frame system to a support surface.

2. The frame system of claim 1, wherein the back plate includes a plurality of corner guides that are received within a channel formed in the inner landing and assist in self-aligning the image substrate.

3. The frame system of claim 2, wherein the plurality of ribs includes a set of first ribs formed along the inner face, a set of second ribs formed along the inner face; and a set of third ribs that extend outwardly from the inner landing and are spaced from the inner face.

4. The frame system of claim 3, wherein the set of third ribs are formed on an inner side of the channel of the inner landing and the set of second ribs and the set of first ribs are located on an outer side of the channel.

5. The frame system of claim 4, wherein the back plate includes a plurality of center tabs, wherein each wall of the back plate includes two locking ribs and one center tab located between the two locking ribs, the center tab being disposed adjacent and in contact with one pair of third ribs, each center tab between disposed between one pair of third ribs and one respective wall of the outer frame element.

6. The frame system of claim 5, wherein the set of second ribs have curved surfaces that face inwardly and are intended to contact an image substrate that seats against the inner landing and is captured between the outer frame element and the back plate.

7. The frame system of claim 1, wherein one corner area includes a locking post for detachably coupling to a kickstand that is configured for reception into an engagement with one mounting opening that is formed in the back plate.

8. The frame system of claim 7, wherein the locking post includes a circumferential undercut and the locking post is received within an opening formed in the kickstand, the opening being open to an in communication with one edge of the kickstand via a slit that allows flexing of the kickstand.

9. The frame system of claim 1, wherein the back plate is defined by four walls with each of the four walls including a center tab and the outer frame element includes four walls with each of the four walls including one pair of center protrusions that are opposed by the center tab on the adjacent wall of the back plate, the combined center tab and pair of center protrusions configured to prevent outward flexing of the outer frame element relative to the back plate.

10. The frame system of claim 1, wherein the inner landing has a channel formed therein and an inner edge of the inner landing has a plurality of protrusions formed integrally with the inner landing and extending outwardly from the inner edge, the plurality of protrusions being configured for positioning the image substrate thereon.

11. The frame system of claim 1, wherein the plurality of ribs includes a first set of ribs that are formed along the inner face for positioning against an outer peripheral edge of the image substrate.

12. The frame system of claim 1, wherein the inner landing has a channel formed therein and the back plate has a plurality of corner guides each formed in one corner of the back plate, the corners guides having walls formed at a right angle to allow each corner guide to engage the channel of the inner landing in each corner.

13. The frame system of claim 12, wherein each corner guide is located between two locking ribs formed along perpendicular walls of the back plate.

14. A frame system for holding an image substrate comprising:

a hollow outer frame element that includes a plurality of recesses formed along inner faces of walls of the outer frame element, the outer frame element further including a plurality of ribs formed along the inner face and an inner landing that protrudes inwardly into a center opening of the outer frame element; and a back plate configured for insertion into the center opening, the back plate including a plurality of locking ribs for reception within the plurality of recesses to generate a snap-fit attachment of the back plate to the hollow outer frame element;

wherein each corner of the frame system is defined by one pair of locking ribs of the plurality of locking ribs that are formed at a 90 degree angle relative to one another and each locking rib of the pair of locking ribs having a localized protrusion that extends outwardly toward to outer frame element and when the plurality of locking ribs are received with the plurality of recesses, a space is formed between the plurality of plurality of locking ribs and the outer frame element and is open along a rear edge of the frame system.

15. The frame system of claim 14, further comprising a disengagement tool comprising a substrate that is bent at a 90 degree angle, the disengagement tool being configured for reception within the space and for contacting the localized protrusions to cause inward flexing of the plurality of locking ribs and disengagement of the plurality of locking ribs from the plurality of recesses to permit separation of the outer frame element from the back plate.

16. The frame system of claim 14, wherein the disengagement tool comprises a plastic card bent at the 90 degree angle.

17. A framed article comprising an image substrate having a front face and an opposite rear face; and a frame system for holding the image substrate, the frame system comprising:

a hollow outer frame element that includes a plurality of recesses formed along inner faces of walls of the outer frame element, the outer frame element further including a plurality of ribs formed along the inner face and an inner landing that protrudes inwardly into a center opening of the outer frame element, wherein the outer frame element includes an inwardly directed lip that has a first contact surface; and a back plate configured for insertion into the center opening, the back plate including a plurality of locking ribs for reception within the plurality of recesses to generate a snap-fit attachment of the back plate to the hollow outer frame element, wherein the black plate has a plurality of corner platforms that define second contact surfaces;

wherein the front face of the image substrate seats against the first contact surface and the rear face of the image substrate seats against the second contact surfaces;

wherein the inner landing has a groove formed therein into which a portion of the back plate is received.

18. The framed article of claim 17, wherein each corner of the frame system is defined by one pair of locking ribs of the plurality of locking ribs that are formed at a 90 degree angle relative to one another and each locking rib of the pair of locking ribs having a localized protrusion that extends outwardly toward to outer frame element and when the plurality of locking ribs are received with the plurality of recesses, a space is formed between the plurality of plurality of locking ribs and the outer frame element and is open along a rear edge of the frame system.

19. The framed article of claim 18, further comprising a disengagement tool comprising a substrate that is bent at a 90 degree angle, the disengagement tool being configured for reception within the space and for contacting the localized protrusions to cause inward flexing of the plurality of locking ribs and disengagement of the plurality of locking ribs from the plurality of recesses to permit separation of the outer frame element from the back plate.

* * * * *